US009936807B2

(12) United States Patent
Ryan et al.

(10) Patent No.: US 9,936,807 B2
(45) Date of Patent: Apr. 10, 2018

(54) SUPPORT RACK AND METHODS OF MAKING AND USE

(71) Applicants: Shane Collins Ryan, Reno, NV (US); Joanne K. Ryan, Reno, NV (US); Robert C. Ryan, Reno, NV (US)

(72) Inventors: Shane Collins Ryan, Reno, NV (US); Joanne K. Ryan, Reno, NV (US); Robert C. Ryan, Reno, NV (US)

(73) Assignee: Shane Collins Ryan, Reno, NV (US)

( * ) Notice: Subject to any disclaimer, the term of this patent is extended or adjusted under 35 U.S.C. 154(b) by 0 days.

(21) Appl. No.: 14/641,139

(22) Filed: Mar. 6, 2015

(65) Prior Publication Data

US 2016/0022037 A1 Jan. 28, 2016

Related U.S. Application Data

(63) Continuation of application No. 11/677,500, filed on Feb. 21, 2007.

(60) Provisional application No. 60/775,660, filed on Feb. 21, 2006.

(51) Int. Cl.

| | |
|---|---|
| ***A47B 81/00*** | (2006.01) |
| ***A47F 5/08*** | (2006.01) |
| ***A63B 71/00*** | (2006.01) |
| ***A63C 11/02*** | (2006.01) |
| ***A47B 95/00*** | (2006.01) |

(52) U.S. Cl.

CPC ..... *A47B 81/005* (2013.01); *A47B 95/008* (2013.01); *A47F 5/0846* (2013.01); *A63B 71/0036* (2013.01); *A63C 11/028* (2013.01); *A63B 71/0045* (2013.01)

(58) Field of Classification Search

CPC ..... A47B 81/00; A47B 81/005; A47B 95/008; A63C 11/028; A63B 47/00; A63B 55/00; A63B 60/56; A63B 71/0045; A47F 5/0846

USPC ..... 211/85.7

See application file for complete search history.

(56) References Cited

U.S. PATENT DOCUMENTS 3,285,426 A * 11/1966 Wilcke ..... B25H 3/04 211/70.6
4,674,240 A * 6/1987 Strausheim ..... A47F 5/0846 211/189
4,763,797 A * 8/1988 Egan ..... A63C 11/028 211/70.5
4,809,479 A * 3/1989 Tierno ..... E04F 13/0864 211/189
5,193,694 A * 3/1993 Wave ..... A63C 11/028 211/60.1

(Continued)

*Primary Examiner* — Ko H Chan

(74) *Attorney, Agent, or Firm* — Holland & Hart LLP

(57) ABSTRACT

A rack support and method of use. The support rack can include a plurality of support slats mounted to a support base. The support slats cooperatively provide a plurality of article mounting channels, and article mounts can be slidably mounted in the channels in order to provide a variety of orientations of the article mounts with respect to the support base. In one embodiment, the support channels are T-shaped, and the article mounts have T-shaped mounting ends that may slidably mount with the T-shaped support channels. Other support channel and mounting end shapes may be used. In some embodiments, the rack support may be used to store articles on a wall with increased article density, economy, reliability, safety, and/or usability.

9 Claims, 10 Drawing Sheets

(56) References Cited

U.S. PATENT DOCUMENTS

| | | | | | |
|---|---|---|---|---|---|
| 5,301,823 | A * | 4/1994 | Kingery | A47F 5/0876 | 211/175 |
| 5,477,645 | A * | 12/1995 | Bauer | A47F 5/0846 | 52/146 |
| 5,775,521 | A * | 7/1998 | Tisbo | A47B 17/033 | 211/11 |
| 5,941,026 | A * | 8/1999 | Eisenreich | A47F 5/0846 | 211/103 |
| 6,311,854 | B1 * | 11/2001 | Anderson | A47F 5/0846 | 211/70.6 |
| 6,325,223 | B1 * | 12/2001 | Hannen | A47F 5/0846 | 211/87.01 |
| 6,695,154 | B2 * | 2/2004 | Jacobs | A63C 11/028 | 211/106 |
| D556,025 | S * | 11/2007 | Kubota | D8/372 | |

* cited by examiner

SUPPORT RACK AND METHODS OF MAKING AND USE

CROSS REFERENCE TO RELATED APPLICATION

This application is a continuation of U.S. patent application Ser. No. 11/677,500, filed Feb. 21, 2007, and entitled "SUPPORT RACK AND METHODS OF MAKING AND USE", which claims priority through and also incorporates by reference in its entirety the applicants' prior Provisional Patent Application, filed Feb. 21, 2006, entitled "SUPPORT RACK AND METHODS OF MAKING AND USE", Ser. No. 60/775,660. All such prior applications are hereby incorporated by reference in their entirety. It is to be understood, however, that in the event of any inconsistency between this specification and any information incorporated by reference in this specification, this specification shall govern.

TECHNICAL FIELD

This disclosure relates to a support rack of the type mountable on a wall to store articles on the rack. The disclosure also relates to use of such a support rack.

INTRODUCTION

The applicants, particularly Shane L. Ryan, invented the present invention and developed the prototype for presentation in connection with Shane's participation in the Invention Convention, at Roy Gomm Elementary School, Reno, Nev., in 2006. Shane presented the prototype to his sixth grade class and at the subsequent Invention Convention at the School. He received an A+, and "best of class" nomination from his teacher, Mr. Joseph Ernst, for his work and presentations regarding this invention.

BACKGROUND

Storage of items on walls has long presented a significant problem. In the home environment, for example, garage walls, among others, are commonly used to hang and store a wide variety of items. The types of goods involve may include lawn and garden tools, snow shovels, sporting goods, camping equipment, and many other things. A wide variety of wall storage systems have been developed as a result.

One prior art Rubbermaid™ system has provided a metal rail-based system. The metal rails are mountable horizontally along a wall, and metal article hanging hooks of various shapes and sizes can be slidably mounted to the rails. By use of multiple rails, hooks can be arranged at varying locations both horizontally along a wall and vertically with respect to each along multiple rails mounted one over the other vertically on the wall.

The Rubbermaid™ system is relatively heavy, expensive, and difficult to install. If the user desires to have multiple hooks space vertically from each other along a wall, the user must install multiple rails. If a particular vertical spacing will be need, the installer must determine that spacing in advance and maintain as the rails are mounted to the wall.

Storage of snow skis on a wall has long presented significant problems in particular. For example, a family or ski team may have a number of skiers who each have one or pairs of skis of varying lengths. The differing pairs of skis often have bindings mounted on them of varying length and thicknesses as well.

One common ski storage system has consisted of a single horizontally mounted board with a number of horizontally spaced wooden pegs extending perpendicularly from the board along the associated wall (see FIGS. 1-3). As is shown in FIG. 1, however, this board-and-peg system will allow for storage of only a relatively few pairs of skis adjacent a wall unless, as shown in FIGS. 2 and 3, the various pairs of skis are hung on the pegs so that they extend at differing angles from the wall. This arrangement consumes space distal from the wall, as can be seen in FIG. 1. The skis often are easily knocked off the board-and-peg rack as people, cars, bikes, etc., bump into them, and removal of a given pair of skis often requires removal and remounting of multiple other pairs of skis.

Falling skis can do damage to the surrounding environment, including people in that environment. The skis can themselves be damaged too when they fall off the rack.

This board-and-peg ski storage system also commonly fails, as the wooden pegs break. This system can be similarly inefficient for wall storage of other types of articles either with or without skis on the rack.

SUMMARY

The applicants have invented a new support rack and methods of making and using the rack. The support rack includes a base system on which multiple mounting pegs, tools, or structures may be mounted to move in differing directions with respect to each other. In some embodiments, for example, the mounting structures may be adjustably mounted on the base system horizontally and vertically with respect to each other. The base system may be mounted to a wall, and articles of the same or varying shapes and sized may then be mounted to the support rack.

In certain embodiments, a plurality of support slats are mountable to the base system in parallel, with at least some adjacent pairs of slats spaced from each other to cooperatively form a mounting channel between the adjacent pair of slats and adjacent section of the base system. A plurality of mounting structures may be slidably mounted in these channels.

In some embodiments, the base system is a planar base section. In some embodiments, the support slats are T-shaped, as can be one or more associated mounting channels. One or more mounting structures may also have a T-shaped end for slidable mounting within the T-shaped channel(s).

In some embodiments, the base system, support slats, and mounting structures may be made of a wide variety of materials, such as, for example, one or more among wood, plastic, composite material, or metal.

In some embodiments, the mounting structure may consist of pegs having a variety of shapes, including straight arm pegs, u-shaped pegs, y-shaped pegs, or other configurations of varying lengths, widths, and heights. Alternatively, the mounting structure may comprise shelving mounted to slidable mounting structure, multiple pegs or arms extending from a mounting structure base. In the latter case, the pegs or arms may be adjustably mountable to the mounting structure or base to provide differing distances between the pegs or arms as desired. Mounting structures of varying types may be mixed and matched as desired.

In certain embodiments, not all mounting structure need be slidably mounted to the base system. Other types of mounting structures may be fixedly mounted if desired.

The support rack may be configured to matingly mount to a wall adjacent one or more other support rack sections. The resulting support rack system may be expanded if desired. In certain embodiments, the individual support rack sections can be more easily packaged, shipped, assembled, mounted, repaired, or disassembled.

The support rack can be used to store articles on a wall. In some embodiments, the method of use can include assessing the size or weight of articles to be stored on the support rack and adjusting the location of the mounting structures, such as support pegs as an example, horizontally and vertically with respect to each other in order to mount articles on the board.

In certain embodiments, the method may be used to increase article storage density on a wall. In certain embodiments, the method may be one or more of more reliable, less dangerous, more economical, and more adjustable than other article storage methods.

This brief Summary recites certain aspects of various embodiments disclosed in this application. It is to be understood that a given embodiment need not include all such aspects or address issues noted in the Background above.

In addition, there are many other aspects and advantages of various embodiments. They will become apparent as this specification proceeds.

BRIEF DESCRIPTION OF THE DRAWINGS

The preferred and other embodiments are described with reference to the accompanying drawings in which.

DETAILED DESCRIPTION

Figure 10:
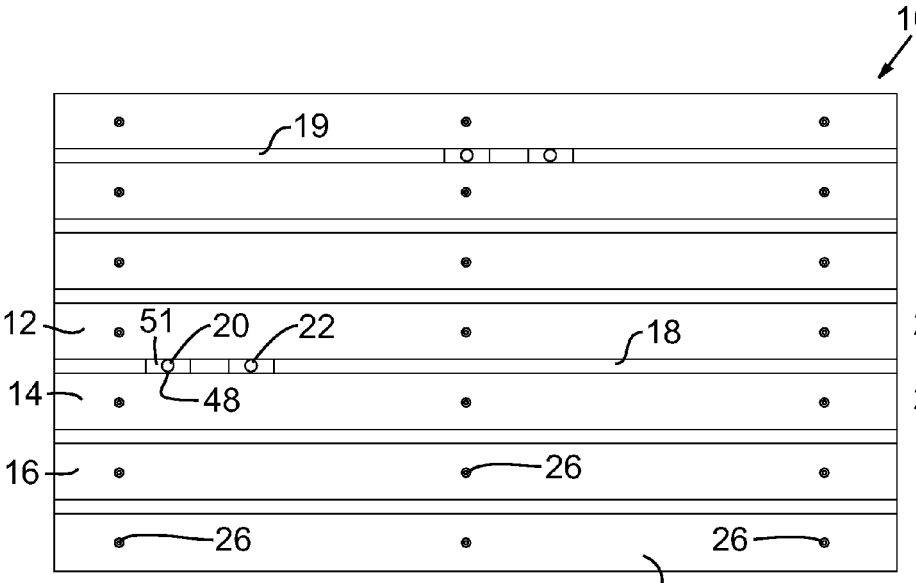
FIG. 10 is an elevational view of the support rack generally shown in FIGS. 4-10.

With reference now to FIG. 10, one embodiment of the support rack 10 includes a plurality of horizontal 3' support slats, e.g., 12, 14, mounted on an underlying 2'×3' support base 16. The support slats 12, 14 are mounted spaced from each other and from the support base 16 to form a support peg or tool channel 18 between the support slats 12, 14. Support pegs, e.g., 20, 22, are slidably mounted within the peg channel 18 thus formed between the slats, e.g., 12, 14. The support pegs, e.g., 20, 22, are thus moveable horizontally with respect to each other and may be moved, if desired, from one peg channel, e.g, 18, to another, e.g., 19, on the support rack 10 to provide vertical adjustability of the position of a support peg with respect to another peg 10 or other structure on the support rack 10.

Figure 12:
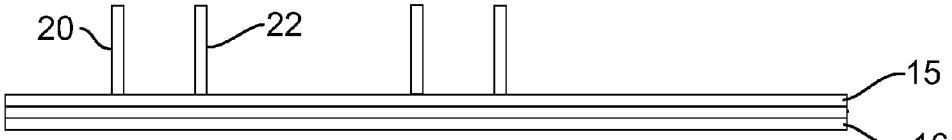
FIG. 12 is a bottom plan view of the support rack of FIG. 10; taken through section A-A in FIG. 10.

With reference now to FIGS. 10 and 12, the support slats, e.g., 14, are secured to the support base 16 by glue (not shown) and fasteners 26 such as screws penetrating the slats, e.g., 15, and support base 16. The slats, e.g., 14, can be secured, including removably mounted if desired, to the support base 16 in many other ways well known to those skilled in the art.

Figure 11:
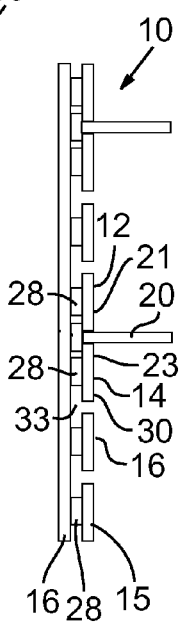
FIG. 11 is a side plan view of the support rack of FIG. 10.
Figure 18:
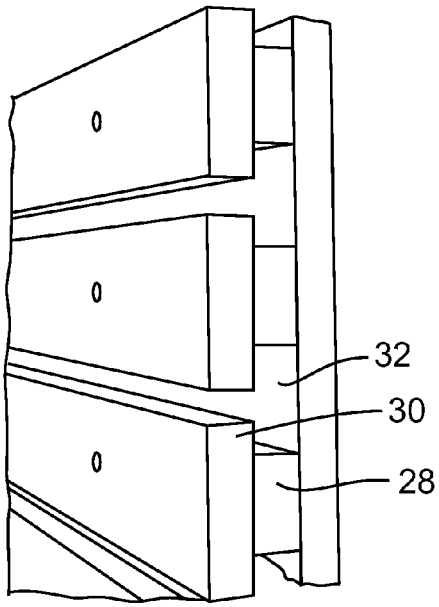
FIG. 18 is a close-up sectional view of Section A of FIG. 17.
Figure 20:
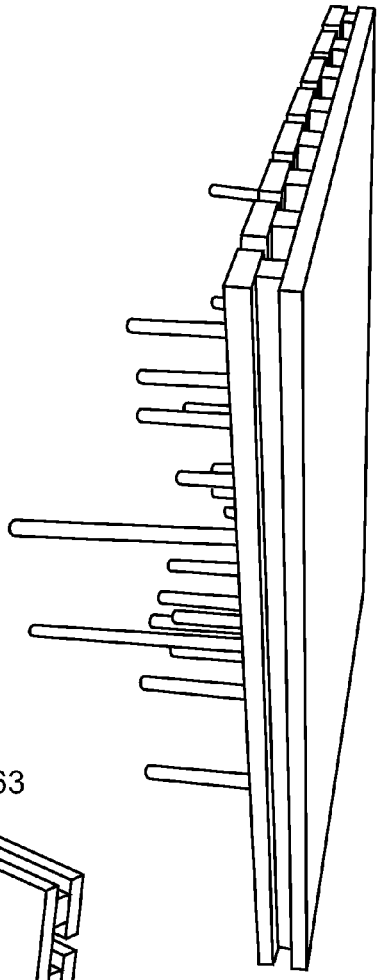
FIG. 20 shows a substantially, but slightly offset, side view of the support rack of FIG. 17.

With reference to FIG. 11 and the similar apparatus of FIG. 18, the support slats, e.g., 14, each have a T-shaped cross-section. The T-shape is provided by a 1"×2"×3' plank 28 mounted to a 1"×3"×3' plank 30. Each peg channel 18 similarly has a T-shaped cross-section cooperatively provided adjacent slats 12, 14. (See also peg channel 32 in FIGS. 18 and 33 in FIG. 11.) As shown in FIGS. 10, 11, support pegs, e.g., 20, 22, are thus slidably mounted within the mating T-shaped peg channel 18, with peg dowels or support members, e.g., 20, 22, extending from the mating channel 18 perpendicularly away from the support base 16 and outer faces 21, 23 of the adjacent support slats 12, 14 respectively.

Figure 13:
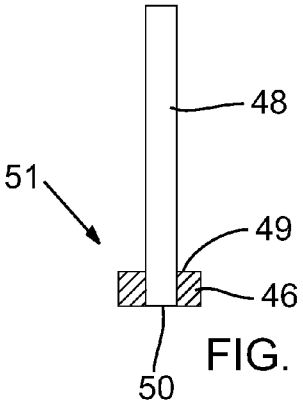
FIG. 13 is a cross-sectional view of a slidable support rack peg of the type useable within peg slots of the support rack of FIGS. 10-12.
Figure 14:
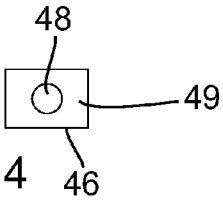
FIG. 14 is an elevational view of the slidable support rack peg of FIG. 13.

With reference now to FIG. 13, the support peg 20 consists of a one to two inch section of 1'×2" wood block 46 with a ⅜"×4" round wood dowel 48 extending perpendicularly from the center of an upper 2" face 49 of the wood block 46. The wood dowel 48 penetrates, and is glued within, a mating dowel passage 50 penetrating the wood block 46. With reference back to FIGS. 10 and 13, the peg channel 18 is thus only slightly wider than the ⅜" diameter of the mating wood dowel, e.g., 48. The wood dowel 48, and its T-shaped wood block end 51 (cooperatively provided by the wood block 46 and the wood dowel 48 perpendicularly extending from the lateral center of the upper 2" face 48 of the wood block 46), are thereby generally slidable along the generally mating interior surface of the T-shaped peg channel 18, with some friction between the them to help maintain the support peg 20 in place after it has been moved to a desired position.

Figure 15:
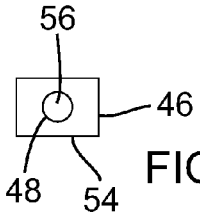
FIG. 15 is a back side plan view of the slidable support rack peg of FIG. 13.

With reference to FIG. 15, the opposing lower 2" face 54 of the wood block 46 is coplanar with one end 56 of the wood dowel 48.

Figure 16:
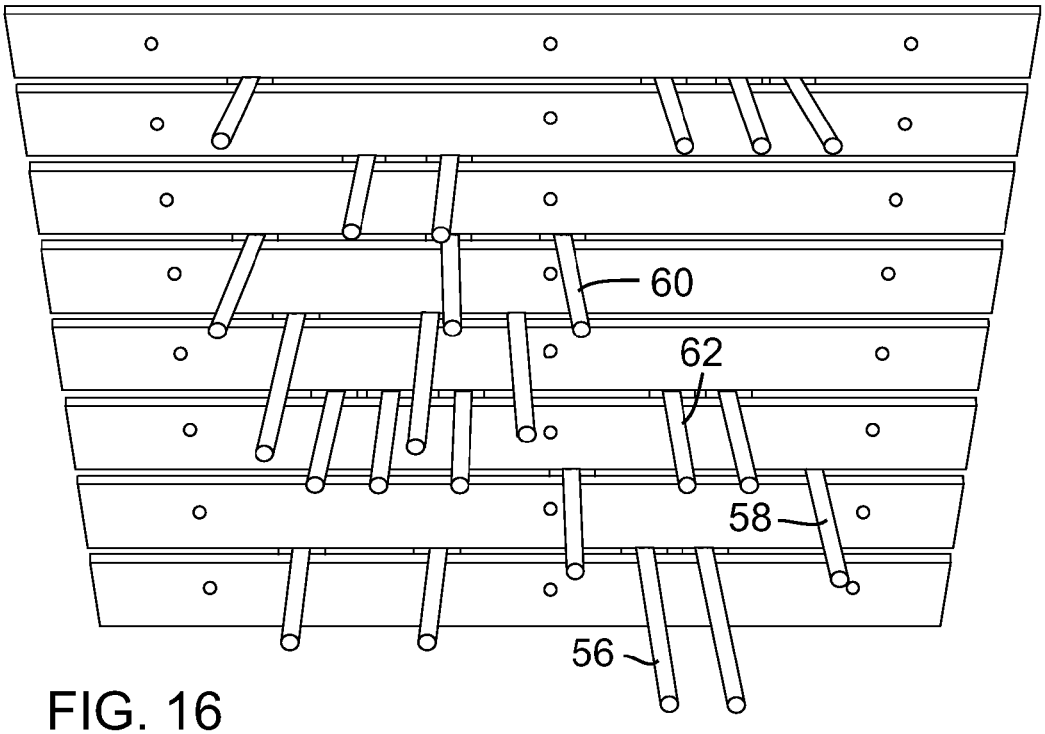
FIG. 16 shows the support rack of FIGS. 4-10 at an angle to perpendicular from the plane of the front surface of the support rack.
Figure 17:
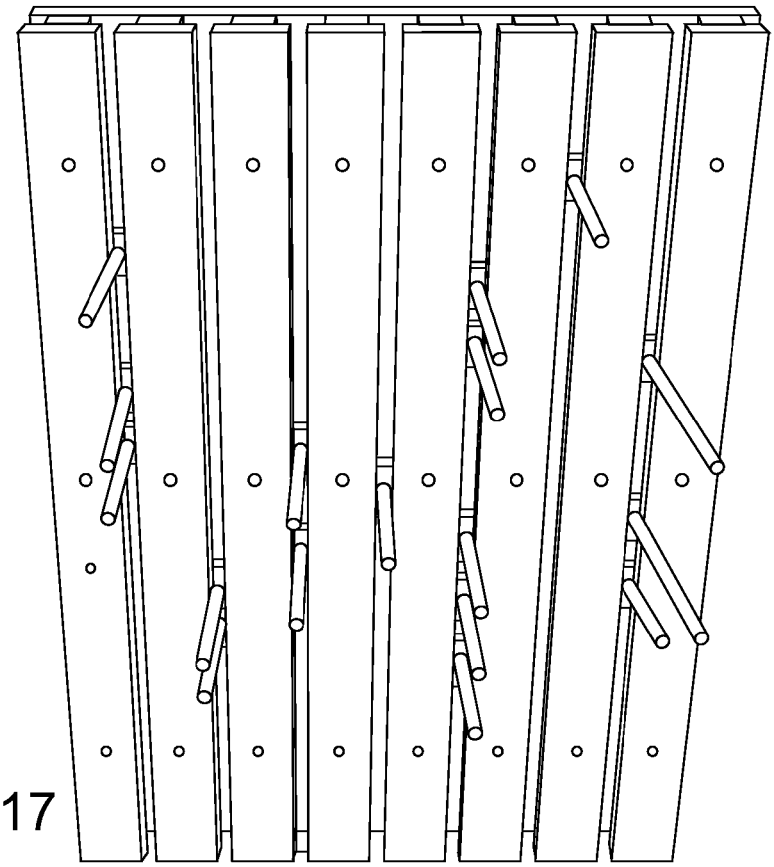
FIG. 17 shows the support rack of FIG. 16 turned ninety degrees and at an angle to perpendicular from the plane of the front surface of the support rack.

With reference to FIG. 16, wood dowels, e.g., 56, 58, may have differing axial lengths, such as, for example, 1.5-8 inches or longer. In addition, a widely varying number of support pegs, e.g., 60, 62, may be mounted on the support base.

Figures 1, 2:
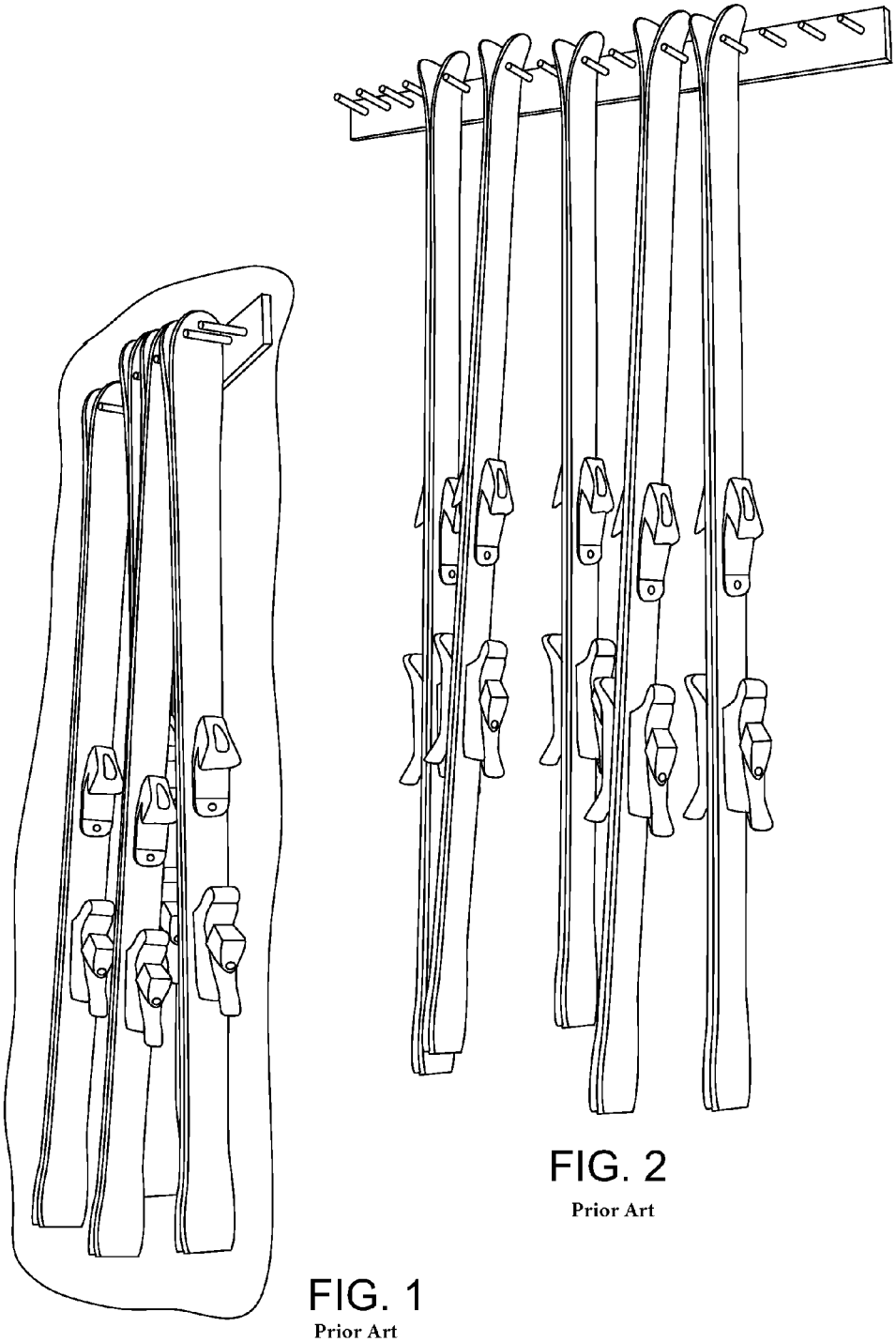
FIG. 2 Prior Art
FIG. 1 Prior Art
FIG. 1 shows a prior art board-and-peg support system with three pairs of skis mounted on the system laterally along a certain lateral length of a wall to which the system is mounted.
FIG. 2 shows the prior art board-and-peg support system of FIG. 2 with five pairs of skis, and two pairs of ski poles mounted on the system along generally the same lateral length of wall reference with regard to FIG. 1 above.
Figure 3:
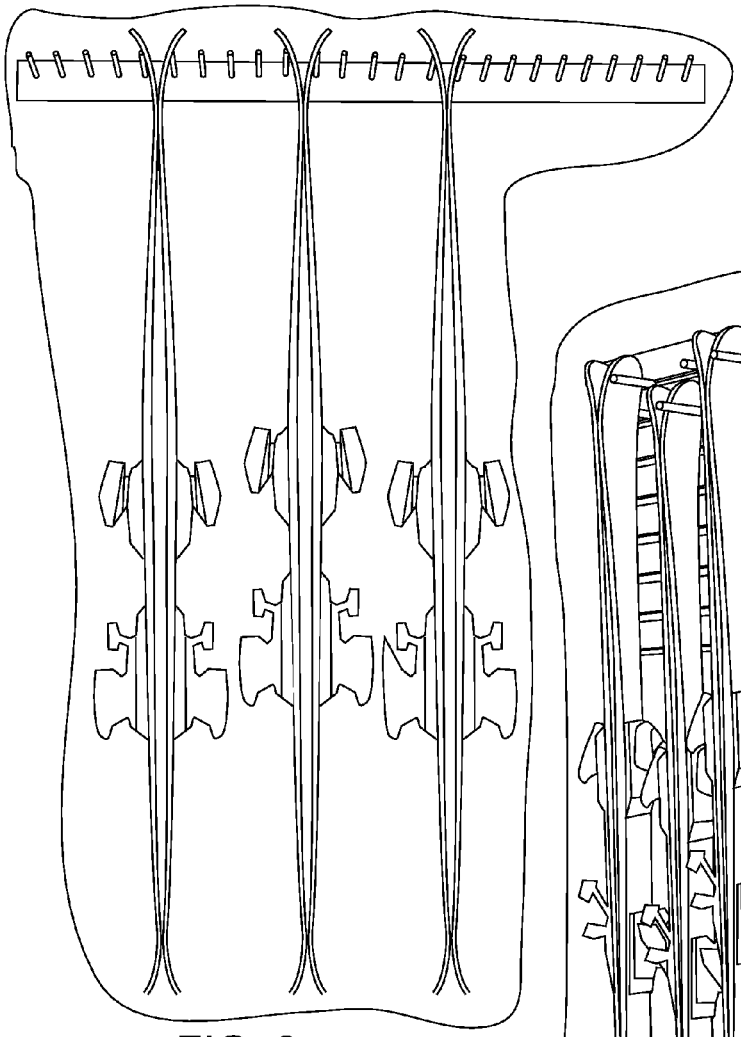
FIG. 3 Prior Art
FIG. 3 shows the prior art board-and-peg system as utilized in FIG. 3, showing the skis and poles extending at an angle away from the wall and into the room framed by the wall.
Figure 4:
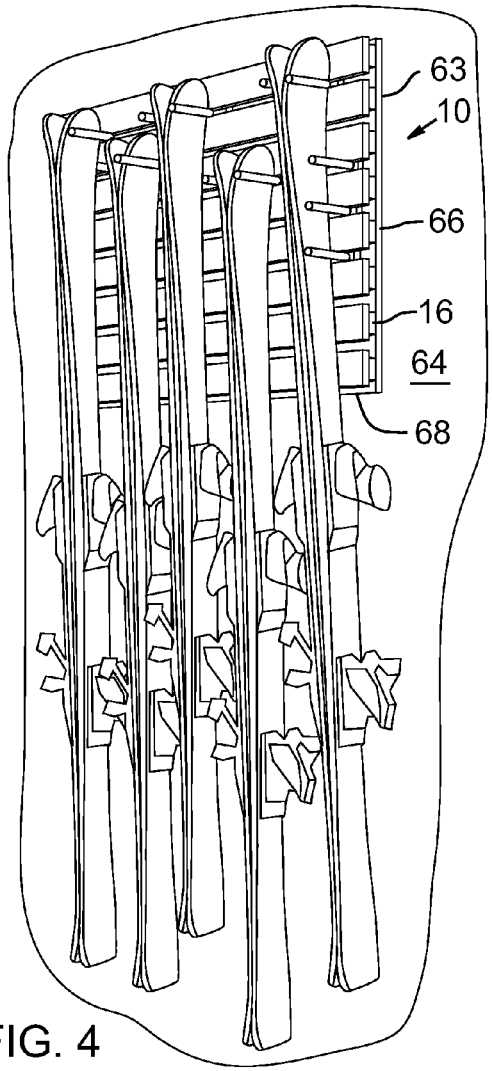
FIG. 4 shows a wood embodiment of a support rack of the present specification mounted on a wall with five pairs of skis mounted laterally along the wall in generally the same lateral length of wall space shown in FIG. 1.
Figure 5:
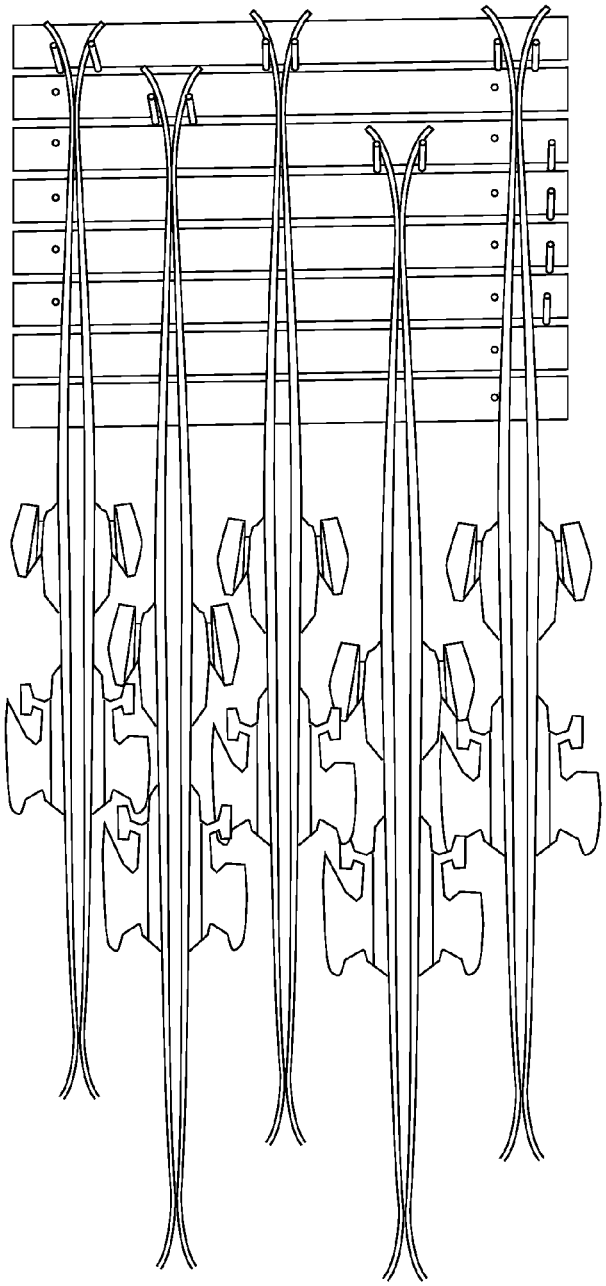
FIG. 5 shows a differing view of the system, and associated mounted skis, of FIG. 4.
Figure 6:
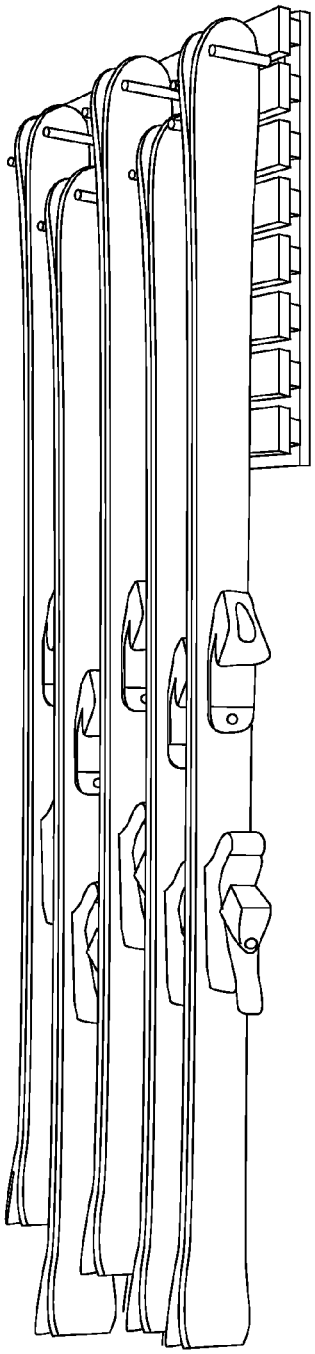
FIG. 6 shows another differing view of the system, and associated mounted skis, of FIGS. 4 and 5, with the skis hanging generally vertically along the associated wall.
Figure 7:
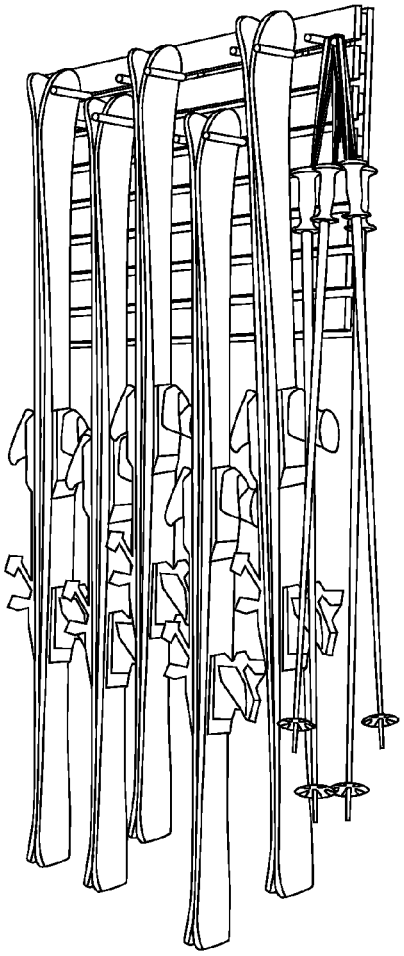
FIG. 7 shows the support rack of FIGS. 4-6 with a number of pairs of ski poles mounted at varying vertical positions along one side of the support rack.
Figure 8:
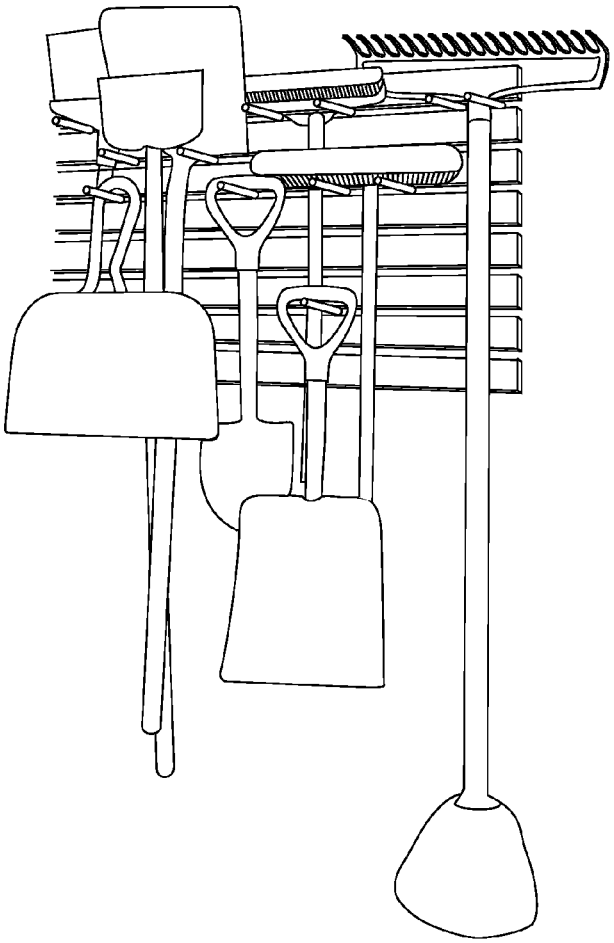
FIG. 8 shows the support rack of FIGS. 4-7 with support pegs adjusted horizontally and vertically along a rack base system in order to support along the wall a variety of differently shaped lawn and garden tools and other implements.
Figure 9:
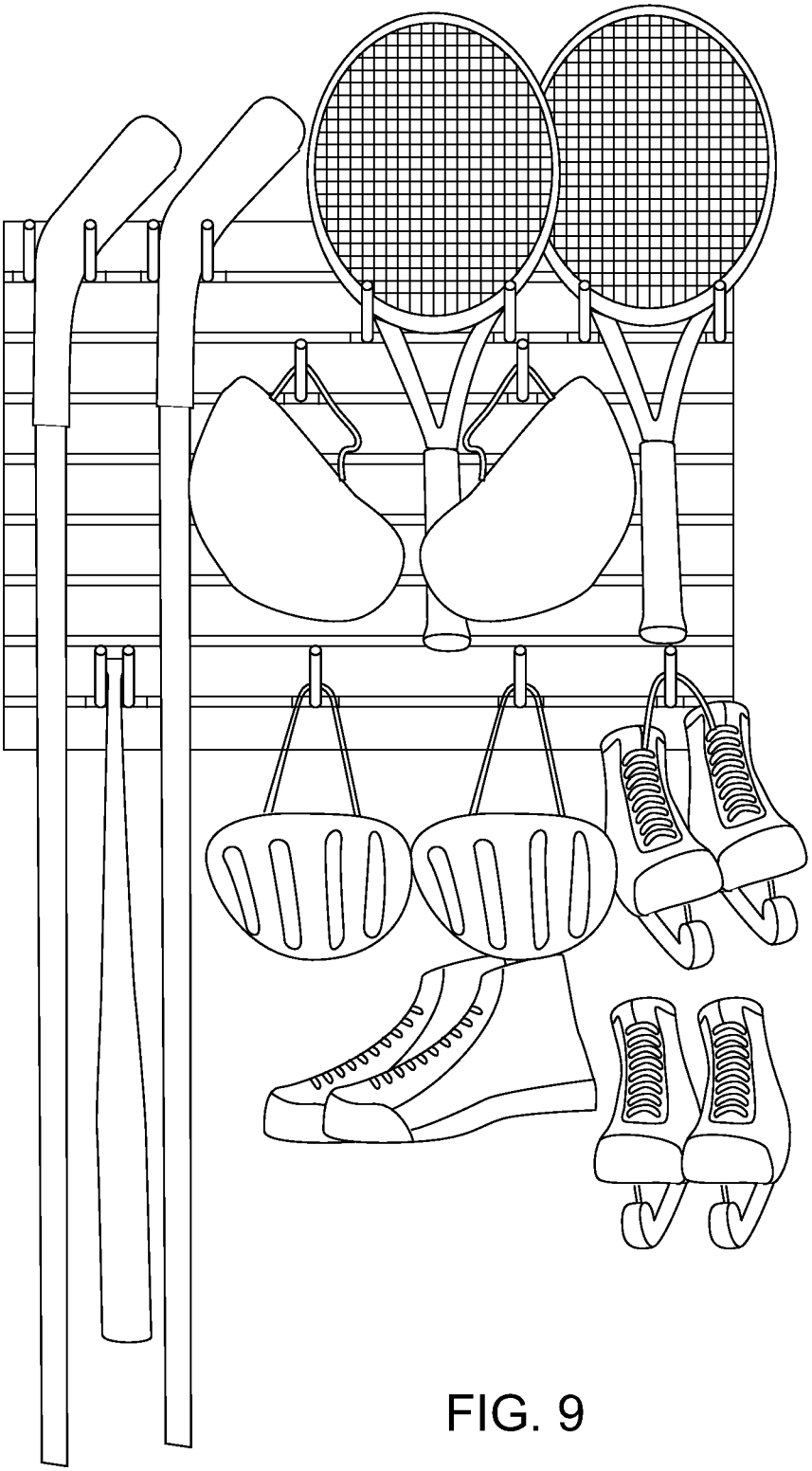
FIG. 9 shows the support rack of FIGS. 4-8 with the support pegs adjusted horizontally and vertically along the rack base system in order to support along the wall a variety of differently shaped sporting goods.
Figure 19:
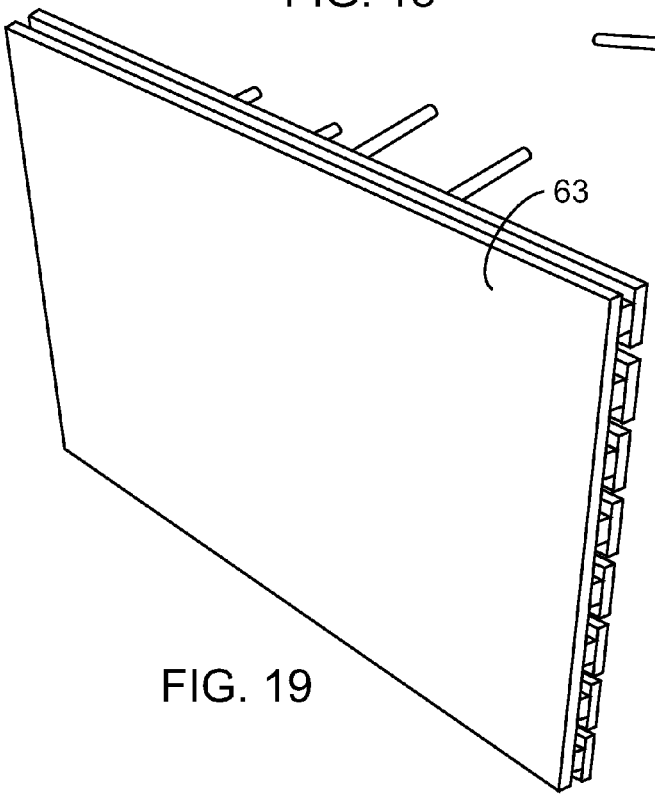
FIG. 19 shows the back side of the support rack of FIG. 17 at an angle to perpendicular from the plane of the rear planar surface of the support rack.

With reference now to FIG. 4, the planar back side 63 (see also FIG. 19) of the support base 16 may be secured to the surface of a wall 64 or other supporting structure (not shown). Additional support racks (not shown) may be mounted to the wall 64 adjacent a side, e.g., 66, 68, of the support rack in order to expand storage capacity of the collective racks.

The components of the support rack 10 may have differing dimensions than the embodiments shown in FIGS. 4-20. For example, the support base may be small or larger as desired. The lateral lengths of support slats may be similarly altered, and in some embodiments, on or more support slats may have differing lengths or widths than those of one or more other support slats on the rack. Similarly, one or more support pegs may have a configuration altered to mate with differently-shaped channels formed in differently configured adjacent support slats.

Figure 21:
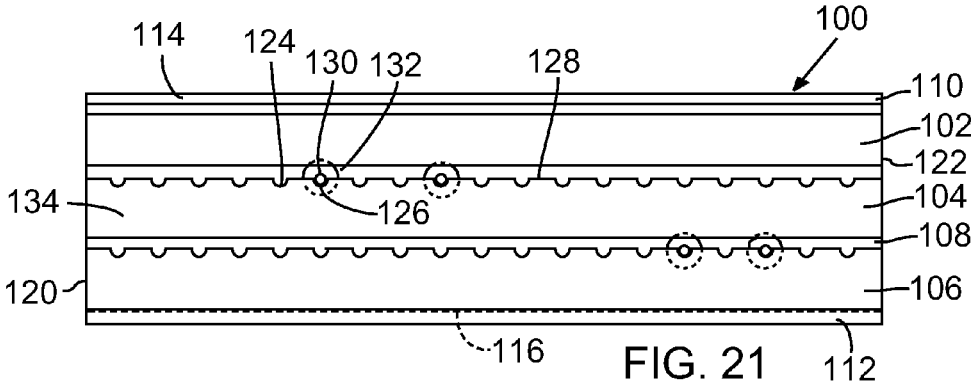
FIG. 21 is an elevational view of an alternative support rack embodiment having three horizontal support slats with a series of arcuate channels in the upper surfaces of the slats and with a four slidable pegs resting in mating arcuate channels.

With reference now to FIG. 21, an alternative support rack may comprise one or support rack sections, e.g., 100. Each such support rack section 100 may have a plurality (e.g., three as shown) lateral support slats 102, 104, 106 mounted on an underlying support base 108. Upper and lower laterally extending L-shaped lips, e.g., 110, 112, can respectively extend from the upper and lower laterally-extending sides 114, 116 of the support base 108. The L-shaped lips 110, 112 can thus matingly abut with reciprocally configured lips (not shown) in additional support rack sections as desired. Similar lip structure (not shown) can be included on the opposing left and right sides 120, 122 respectively on the support base 108 to mate with additional support rack sections that may be mounted to the left and right sides 120, 122 of the support base 108.

Figure 22:
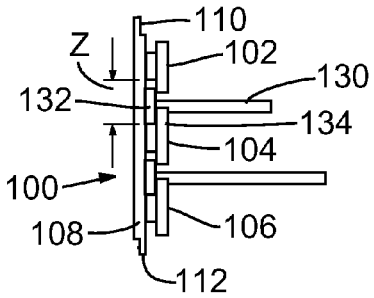
FIG. 22 is a side plan view of the alternative support rack of FIG. 21.
Figure 23:
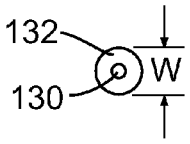
FIG. 23 is an elevational view of an alternative support peg having a round-disc base, of the type shown in the support rack of FIGS. 21 and 22.

One or more arcuate dowel-support depressions or channels, e.g., 124, 126, may be formed in the upper edge 128 of one or more support slats, e.g., 104. As shown in FIGS. 21 and 22, a support dowel, e.g., 130, can thus extend from a dowel base 132 through the dowel-support channel 126 to extend perpendicularly from the outer planar face 134 of the support slat 104. In this embodiment as shown in FIG. 23, the diametral width W of the dowel base 132 is substantially less than, as shown in FIG. 22, the mating maximum width Z of the T-shaped channel 134 in which the dowel base 132 is slidably mounted and retained. This relationship is required to allow, as shown in FIGS. 21 and 22, the dowel 130 to abut the dowel-support depression 126 in the lower abutting support slat 134.

In this embodiment, the support pegs (formed of the dowel base 132 and support dowel 130) are thus slidable laterally along the mating T-shaped channels between adjacent support slats except when the support dowel of the support peg is lowered into a mating support channel along an upper channel in the lower support slat. This orientation of the support peg can resist undesired lateral movement of the support peg within the T-shaped tool channel when the support peg is utilized to support one or more articles (such as, for example, when opposing ski tips of a pair of skis are mounted on and between two support pegs mounted in a tool channel for example) on the support rack. The vertical depth of the dowel-support depression of one or more of the dowel-support channels can be increased, including to form, for example, vertical or near vertical side walls in the depression, to increase the resistance the side walls of the depression will present to forces that may urge a dowel to move laterally with respect to the depression and associated channel.

Figure 24:
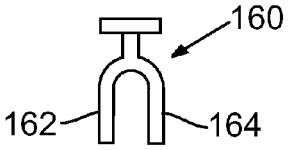
FIG. 24 is a side plan view of an alternative u-shaped support peg structure.
Figure 25:
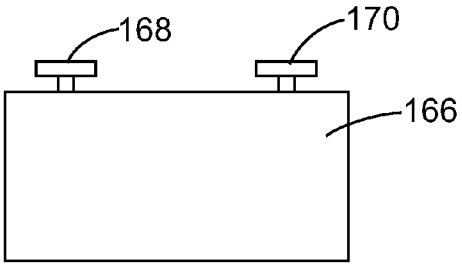
FIG. 25 is a side plan view of an alternative planar shelf-shaped support peg structure.
Figure 26:
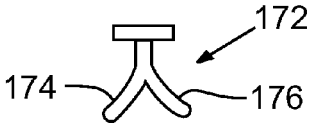
FIG. 26 is a side plan view of an alternative y-shaped support peg structure.

With reference now to FIGS. 24 through 28, support pegs or other support structures may have a variety of yet additional configurations. As shown in FIG. 24, they may, for example, comprise a U-shaped article support 160 with laterally opposing arms 162, 164 to secure an implement, such as a shovel or baseball bat (not shown in FIG. 24) on a support rack. As shown in FIG. 25, they may comprise a planar shelf section 166 extending from two T-shaped support sections 168, 170 for slidable mounting with a tool channel (not shown in FIG. 25). Alternatively, as shown in FIG. 26, they may comprise a Y-shaped article support 172 with laterally oppositely extending Y arms 174, 176 for hanging article components, such as racket ball racket loops or hockey skate laces, in order to mount the articles on the support rack.

Figure 27:
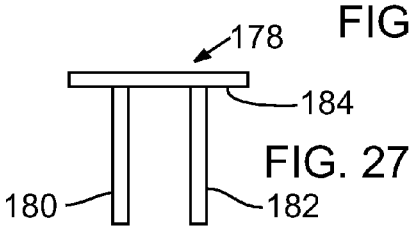
FIG. 27 is a side plan view of an alternative multi-peg somewhat U-shaped support peg structure.
Figure 28:
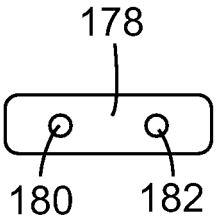
FIG. 28 is an elevational view of the multi-peg structure of FIG. 27.

Similarly, as shown in FIGS. 27 and 28, they may comprise somewhat U-shaped support peg 178, with two opposing, parallel dowel sections 180, 182 extending perpendicularly from a common base mount 184. This somewhat U-shaped embodiment can prevent unacceptable or undesired lateral movement of the two opposing dowel sections 180, 182 with respect to each other, and this resistance to relative movement can thus be achieved with or without utilization of, as shown in FIG. 21, dowel depressions or channels, e.g., 124, 126.

Figure 29:
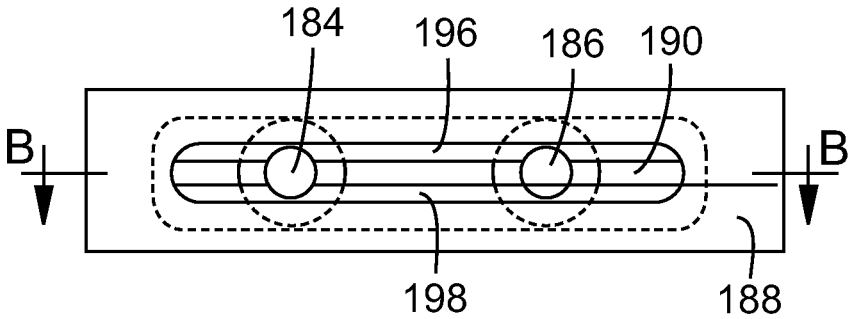
FIG. 29 is a top plan view of an alternative multi-peg structure having slidably adjustable pegs.
Figure 30:
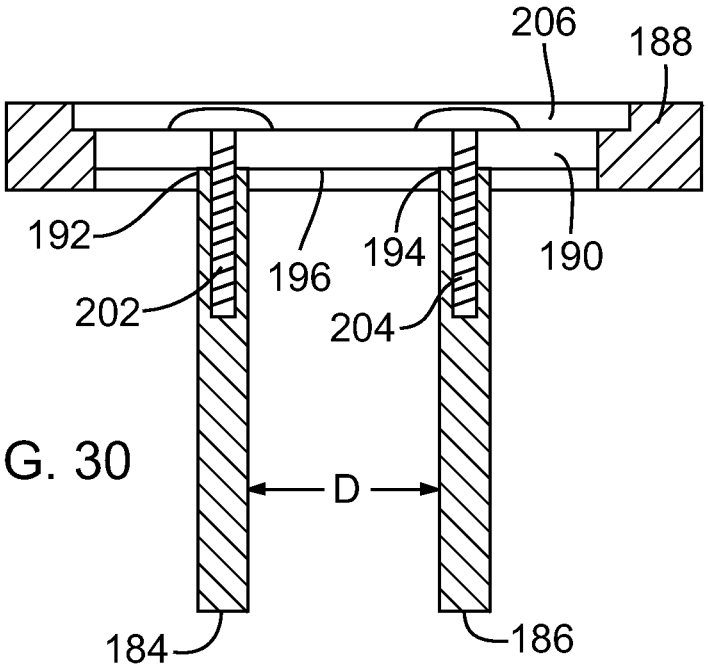
FIG. 30 is a cross-sectional view, taken through section line B-B in FIG. 29.

As shown in FIGS. 29 and 30, one variant of the somewhat U-shaped embodiment of FIGS. 27 and 28 may have opposing dowel sections or arms 184, 186 that may be adjustably secured along the length of a mounting slot 190 in the rectangular base mount 188 with varying distances D between the arms 184 as desired. The adjustably securable ends 192, 194 of dowel arms 184, 186 respectively abut dowel abutting lateral interior ridges 196, 198 extending radially inwardly into, and along opposing sides of, the mounting slot 190. Wide head screw fasteners 200, 202 penetrate the mounting slot 190 from the back side 206 (or mounting base facing side) of the base mount 188 to thread in mating threaded passages 204, 204 in the dowel arms 184, 186 respectively. The screw fasteners may thus be loosened in order to adjust distance D as desired and then tightened to retain the dowel arms 184, 186 in position with respect to each other and the base mount 188.

The structure of FIGS. 29 and 30 can thus provide an adjustable somewhat U-shaped slidably mountable support peg structure. The adjustability of the distance D can allow use of the same type of support peg structure but adapt it as needed to support differing implements on the rack. As an example, the distance D on differing such support peg structures of this type can be varied to support differing pairs of skis having varying tip structures to be supported by the opposing dowel arms on the support peg structure.

Adjustable two peg support structures may be provided in other ways if desired. Another such structure can have more than two, for example five or six if desired, dowel mounting passages along the face of the peg base. The dowels may therefore be mounted in the selected mounting passage to achieve the selected distance between the dowels. Fasteners may be used to secure to the dowels in the desired dowel mounting passages.

In addition, more than two dowels may be mounted to a peg support base if desired. Similarly, dowels or other structure, such as a shelf, may be integrally formed to extend from the slidably mountable support structure for the shelf or other article support section or member.

The components of the support rack may be made of materials other than wood, metal fasteners, and glue. For example, one or more among the rack base, support slats, and support pegs or similar structure or dowels may be made of one or more types of plastic, such as, for example polystyrene, polycarbonate, acrylic, etc. Doing so can, in some embodiments, provide one or all of a lighter, less costly, more durable, and more inexpensively shipped and/or easily assembled, mounted, and/or maintained support rack.

Alternatively, one or more of such components may be made of metal such as aluminum or other metal material. Doing so can, in some embodiments, provide a more durable support rack or a more aesthetically appealing support rack, depending on the aesthetic objective involved.

With reference back to FIGS. 4-7, certain embodiments can be used to store skis. The method includes mounting the support rack to a wall at a height sufficient to support skis as desired on the rack, assessing the configuration of the skis, including their bindings, to be mounted on the rack, and slidably mounting support pegs or similar support peg structure on the support rack in order stagger the position of adjacent bindings or adjacent skis mounted on the rack as they are mounted to the rack, so that the skis may be mounted close together laterally along the length of the rack while also, if desired, minimizing the protrusion of the skis away from the wall. The method may also include slidably mounting support pegs or other support structure on the rack in order to hang ski poles or other articles from the pegs or other support structure.

With reference back to FIGS. 8-9, certain embodiments can be used to store many other widely varying types of articles—other than skis or in addition to them. The method includes mounting the support rack to a wall at a height sufficient to support the articles on the rack, assessing the configuration of the various articles to be mounted on the support rack, and slidably mounting support pegs or similar support peg structure in selected support channels on the support rack in order to mount the ski tips (or other ski structure such as bindings if desired) to the support rack and stagger the position of adjacent articles mounted on the rack. In this manner if desired, the various articles may be mounted close together on the rack while also, if desired, minimizing or reducing as desired the protrusion of the articles away from the associated wall.

These methods may include selection, mounting, and utilization of varying configurations of support pegs or other slidably mountable support structures as desired. These methods may also include, prior to or after mounting of the base section of the rack on a wall, selecting differing sized support slats or differently configured pegs or other slidably mountable support structure, in order provide differently configured support racks.

In this regard, the support slats may be mounted to a support base system in a variety of differing ways other than those identified above. The support base may include one or more, or a large number of, mounting passages, slots, support lips or ridges, or other structure; and the support slats may have mating pegs, clips, mounting lips or ridges, or other structure for mounting the support slats to the support base. For example, the support base may comprise a peg board type of structure, made out of sufficiently strong metal, plastic, or wood. Such structures can, in certain embodiments, render the support rack easier to assemble, modify to yield varying configurations, maintain, or disassemble.

In certain embodiments, the support racks can include other types of channels, such as vertical channels extending from one horizontal support channel to another. Such a vertical channel could allow moving a support peg or other structure from the one horizontal support channel to the other or yet additional horizontal support channels when desired or needed and, if desired, without requiring the user to move any or as many articles from the support rack as otherwise would be required to accomplish such movement.

The foregoing is a detailed description of varying embodiments. It is not itself limiting. Rather the scope of the invention is to be determined by reference to the claims as issued.

We claim:

1. A support rack of the type readily mountable to mating wall to support skis comprising in combination:

a. a support base comprising dominantly of plastic and having a wall mounting side mountable to a planar wall and an article mounting side opposite the wall mounting side, the article mounting side including a plurality of substantially parallel support slat sections comprising dominantly of plastic and extending from the article mounting side, a first support element mounting channel cooperatively provided by one adjacent pair of said support slat sections, and a second support element mounting channel cooperatively provided by a second adjacent pair of support slat sections, whereby the support base and parallel support slat sections may be manually lifted and mounted to a mating wall as a unitary structure; and b. a plurality of article mounting elements slidably orientable in the first support element mounting channel or the second support element mounting channel in said base system, each article mounting element comprising dominantly of plastic and comprising a slidable article mounting section and a support arm extendable from the slidable article mounting section, the slidable article mounting section being slidably mountable in each of the first support element mounting channel and the second support element mounting channel, one article mounting element among the plurality of mounting elements having a plurality of article support arms extendable from the slidable article mounting section, with each of at least two among the plurality of support arms being adjustably slidable within the slidable article mounting section.

2. The support rack of claim 1 wherein the support rack comprises dominantly of plastic.

3. The support rack of claim 1 wherein the support rack comprises substantially entirely of plastic.

4. The support rack of claim 1 wherein first support element mounting channel is substantially parallel to the second support element mounting channel.

5. The support rack of claim 2 wherein the first support element mounting channel is substantially parallel to the second support element mounting channel.

6. The support rack of claim 3 wherein the first support element mounting channel is substantially parallel to the second support element mounting channel and includes article mounting section retention structure, whereby one or more slidable article mounting sections may be retained in position with respect to the first support element mounting channel.

7. The support rack of claim 1 wherein the plurality of support slat sections cooperatively provide at least a third support element mounting channel.

8. The support rack of claim 5 wherein the plurality of support slat sections cooperatively provide at least a third support element mounting channel and a fourth support element mounting channel.

9. The support rack of claim 1 consisting of more than two and less than seven support element mounting channels.

* * * * *